US007699426B2

(12) United States Patent
Matsumoto et al.

(10) Patent No.: US 7,699,426 B2
(45) Date of Patent: Apr. 20, 2010

(54) IMAGE PROCESSING METHOD AND INK JET PRINTING APPARATUS

(75) Inventors: Nobuyuki Matsumoto, Tokyo (JP); Minoru Nozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 612 days.

(21) Appl. No.: 11/447,159

(22) Filed: Jun. 6, 2006

(65) Prior Publication Data

US 2006/0279600 A1 Dec. 14, 2006

(30) Foreign Application Priority Data

Jun. 9, 2005 (JP) ..... 2005-170014

(51) Int. Cl.
*B41J 29/393* (2006.01)
*B41J 29/38* (2006.01)
*B41J 2/165* (2006.01)

(52) U.S. Cl. ..... 347/19; 347/14; 347/35

(58) Field of Classification Search ..... 347/22, 347/43, 9, 14, 19, 29, 35
See application file for complete search history.

(56) References Cited

U.S. PATENT DOCUMENTS 6,402,292 B1 * 6/2002 Ninomiya ..... 347/35

FOREIGN PATENT DOCUMENTS

JP 8-112904 5/1996
JP 09216388 A * 8/1997
JP 2002225301 A * 8/2002

* cited by examiner

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

An ink jet printing apparatus for performing maintenance ejection onto a printed image makes it possible to obtain a favorable printing image by rendering maintenance ejection ink dots inconspicuous. Pixel position comparison is performed between an objective pixel and data in a pixel position at the same address to detect whether image data is present at the same address. When the image data is not present in the same position, comparison operation is performed on a subsequent objective pixel. When the image data is present in the same position, processing with an image processing mask is performed on the image data in a print buffer. The image data in the print buffer is combined with the maintenance ejection data to generate image printing data. This image processing makes it possible to thin out dots from the image data and to render the maintenance ejection ink dots inconspicuous.

8 Claims, 12 Drawing Sheets

| INK DROPLETS | ABOUT 5 pl | | ABOUT 3 pl | | ABOUT 2 pl | |
|---|---|---|---|---|---|---|
| MAINTENANCE EJECTION NUMBER OF DOTS 5 DOTS | 3 COLORS | | 3 COLORS | | 3 COLORS | |
| | WHITE BACKGROUND | YELLOW BACKGROUND | WHITE BACKGROUND | YELLOW BACKGROUND | WHITE BACKGROUND | YELLOW BACKGROUND |
| PLAIN PAPER #1 DOMESTIC IJ PAPER | × | × | × | × | ○ | ○ |
| PLAIN PAPER #2 DOMESTIC HIGH-QUALITY PAPER | × | × | × | × | ○ | ○ |
| PLAIN PAPER #4 IMPORTED IJ PAPER | × | × | × | × | ○ | ○ |
| PLAIN PAPER #5 IMPORTED RECYCLED PAPER | × | × | ◎ | × | ◎ | × |
| PLAIN PAPER #6 IMPORTED BOND PAPER | × | × | △ | × | ○ | ○ |
| COATING PAPER PAPER EXCLUSIVELY FOR IJ | × | × | ◎ | × | ◎ | × |

FIG.4

IMAGE PROCESSING METHOD AND INK JET PRINTING APPARATUS

BACKGROUND OF THE INVENTION

1. Field of the Invention

The present invention relates to an image processing method and an ink jet printing apparatus. More specifically, the present invention relates to an image processing method and an ink jet printing apparatus for the case of performing maintenance ejection onto a printing medium for the purpose of maintenance of an ink nozzle for ejecting ink.

2. Description of the Related Art

An ink jet printing apparatus has various advantages including low noises, low running costs, capabilities of downsizing the apparatus and color printing, and so forth. Such an ink jet printing apparatus is configured to print an image on a printing medium by ejecting ink from ink ejection nozzles provided in an ink jet printing head. The trend is that ink droplets ejected therefrom are becoming smaller from about 15 pl to 5 pl, or further to 2 pl. Thus, graininess is reduced, for example, in a halftone part of a gray-scale image, in a gradation part of a color image and in a highlighted part. Along with reduction in size of droplets, an aperture size of an ink ejection nozzle orifice is also reduced.

Incidentally, water evaporation of the ink in the vicinity of the nozzle orifice is accelerated when the ink is not ejected from the ink ejection nozzle. A clogged orifice caused by an increase in viscosity of the ink leads to defective ejection such as deviation in the direction of ink ejection and failure of an ink droplet to reach a sheet surface. Moreover, such defective ejection tends to occur more often when the nozzle orifice has a small orifice diameter. Meanwhile, the defective ejection may also occur due to other reasons such as adhesion of minute paper powder or water droplets on the nozzle orifice.

To solve aforementioned problems of the defective ejection, an ink jet printing apparatus has been conventionally configured to perform ink ejection outside a printing sheet area immediately before printing or at periodic intervals in the course of printing. This maintenance ejection which is ink ejection aiming at maintenance is performed either arbitrarily or periodically at a waste ink absorber, an aperture region exclusively used for maintenance ejection and the like, which are disposed inside the printing apparatus. Although a scale of maintenance ejection varies depending on ejection power of a printing head used therein, a drying performance of ink used therein, an environmental temperature, and the like, several shots to over a dozen shots of ejection are usually performed at an interval of about 3 to 10 seconds.

When this maintenance ejection is performed during a process of printing an image on a printing medium by scanning the medium with a carriage mounting the printing head, the carriage has to travel from a position for printing the image to a predetermined position outside the printing medium where the waste ink absorber is located. Therefore, required time duration from start to end of printing the image on the printing medium is extended. In particular, in a high-speed printing mode for minimizing a printing operation per page by use of high-speed printing head movement and maximum performance ejection of the printing head for the purpose of high-speed printing, a loss attributable to the maintenance ejection may occupy a considerable portion from several to over ten percent relative to the total time for printing the image.

Now, a case of performing printing based on data equivalent to one line of a band width of a printing head length on a page by one scanning of the printing head will be described below as an example. A printable area of an A4 printing sheet is defined as being 11 inches long and 8 inches wide, and an image will be printed using a 0.53-inch printing head provided with 320 nozzles for accommodating an ink droplet amount of 30 pl each and a pitch equivalent to 600 dpi. The printing head has to scan 21 scans (movements of the printing head+line feeds) to print an image over one page. Moreover, when a drive frequency of the printing head is equal to 15 kHz and dot density in the scanning direction is equal to 600 dpi, a scanning speed of the printing head is equal to 25 inches per second. Estimating that line feed time, rise time or fall time of the movement of the printing head (rank up and rank down) is equal to 0.1 second each, printing duration per line is approximately equal to 0.52 second. Therefore, a total time duration required for printing on one A4 paper is approximately equal to 11 seconds. Further, estimating that an interval of maintenance ejection is set to 5 seconds, the maintenance ejection will be performed twice during printing on one page. One scan row is inserted for one maintenance ejection operation separately from the printing operation. Accordingly, a rate of the time used for the maintenance ejection to the time used for printing the image is calculated as:

$$2 \text{ scans for maintenance ejection}/21 \text{ scans for printing} = 0.092$$

$$= \text{about } 10\%$$

On the other hand, another conventionally known technique for maintenance ejection control to reduce the time loss associated with the maintenance operation is configured to eject ink on a printing medium not for the purpose of image printing. According to technique, movement of a carriage associated with a maintenance operation is reduced to decrease a time loss. Japanese Patent Application Laid-open No. 8-112904 (1996) discloses a technique for maintenance ejection control focused on which region (such as a white portion without an image, a black image portion and a colored image portion) of a printed image maintenance ejection should take place. Specifically, this publication discloses a method of ejecting ink in the vicinity of an edge of an image or a method of forming a watermark on a printing medium so that such a visible image does not cause a problem.

However, the place, the number, and other parameters of maintenance ejection onto a printed image are preset in the conventional example described above, and the maintenance ejection is performed regardless of presence of an image to be printed on a printing medium, ink colors, and the like. In this concern, the pattern of the maintenance ejections may be visible as an image depending on the presence or absence of a printed image on a printing medium on which the ink is ejected by the maintenance ejection, and a relation between the color of ink to be ejected by the maintenance ejection and the color of the printed image.

In other words, visibility of ink dots as a result of the maintenance ejection tends to be different between the case of performing the maintenance ejection on to a white portion of a printing medium and the case of performing the maintenance ejection on a printed portion. Such a difference may pose visibility problems of the ink dots in some cases.

For example, when cyan ink is ejected as the maintenance ejection onto a yellow solid image, such ink dots are prone to be more visible (conspicuous) than ink dots ejected onto a white region.

FIG. 1A and FIG. 1B are views schematically showing print samples subjected to visibility judgments of ink dots ejected as the maintenance ejection onto printing media such as paper sheets. FIG. 1A shows a state of performing the maintenance ejection of one dot onto a white portion of the paper sheet while FIG. 1B shows a state of performing the maintenance ejection of one dot onto a solid portion in a printed image in a different color from that of the image. Here, a lattice 210 is provided for schematically illustrating the print resolution and is not printed in actuality.

FIG. 1A shows the ink dot formed by the maintenance ejection onto the white portion and FIG. 1B shows the ink dot formed by the maintenance ejection when there is a solid image in a different color as a background. When there is the solid image in the different color as a background, an ink dot of the maintenance ejection bleeds into solid image ink dots 220 of the different color and the shape of the ink dot spreads irregularly (reference numeral 230). Accordingly, visibility of the ink dot ejected as the maintenance ejection is increased.

SUMMARY OF THE INVENTION

The present invention has been made in view of the above problems. An object of the present invention is to provide an image processing method and an ink jet printing apparatus which makes it possible to reduce visibility of an ink dot ejected onto a printing medium for the purpose of maintenance ejection and thereby obtaining a favorable printed image.

To attain the above object, the present invention provides an image processing method of generating ejection data for an ink jet printing apparatus which was a printing head for ejecting ink and ejects the ink from the printing head to form dots on a printing medium so as to perform printing, the method comprising the steps of: generating maintenance ejection data for ejecting the ink from the printing head onto the printing medium for the purpose of maintaining the printing head; performing comparison operation between positions of maintenance ejection based on the maintenance ejection data and positions of dots to be printed; and generating the ejection data by thinning out the dots to be printed coinciding with the positions of maintenance ejection in the step of performing comparison operation and by combining dot data which has been thinned out and the maintenance ejection data.

Meanwhile, the present invention provides an ink jet printing apparatus which uses a printing head for ejecting ink and ejecting the ink from the printing head to form dots on a printing medium so as to perform printing, the ink jet printing apparatus comprising: means for generating maintenance ejection data for ejecting the ink from the printing head onto the printing medium for the purpose of maintaining the printing head; means for performing comparison operation between positions of maintenance ejection based on the maintenance ejection data and positions of dots to be printed; and means for generating the ejection data by thinning out the dots to be printed coinciding with the positions of maintenance ejection obtained by the means for performing comparison operation and by combining the dot data which has been thinned out and the maintenance ejection data.

According to the configurations described above, the comparison operation between the positions of maintenance ejection based on the maintenance ejection data and the positions of printed dots is carried out, and than the dots to be printed on a position coinciding with the positions of maintenance ejection based on the maintenance ejection data are thinned out. In this way, there are no printed dots in the positions where the ink is ejected for the purpose of the maintenance ejection. Accordingly, overlaps of the maintenance ejection dots and the printed dots can be avoided and thereby bleeding of the maintenance dots into a printed image can be prevented.

As a result, visibility of ink ejected for the purpose of maintenance ejection is reduced even when the ink is ejected onto the printing medium.

The above and other objects, effects, features and advantages of the present invention will become more apparent from the following description of embodiments thereof taken in conjunction with the accompanying drawings.

BRIEF DESCRIPTION OF THE DRAWINGS

FIG. 4 is a table showing results of sensory judgments in terms of visibility of maintenance ejection dots;

DETAILED DESCRIPTION OF PREFERRED EMBODIMENTS

Now, the preferred embodiments of the present invention will be described below in detail with reference to the accompanying drawings.

First Embodiment

Figure 1A:
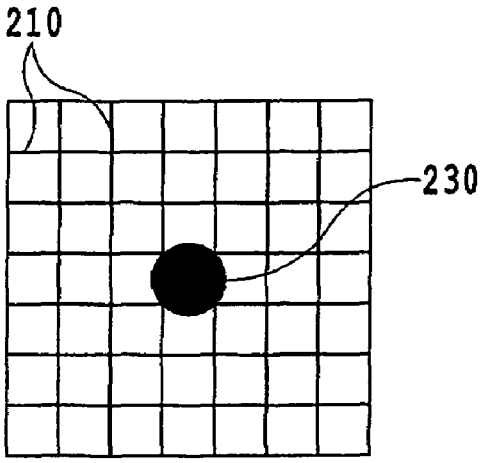
FIG. 1A and FIG. 1B are views schematically showing printing samples subjected to visibility judgments of ink dots.
Figure 1B:
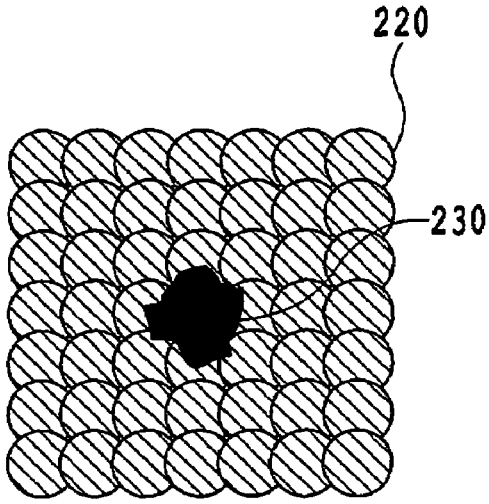
Figure 2:
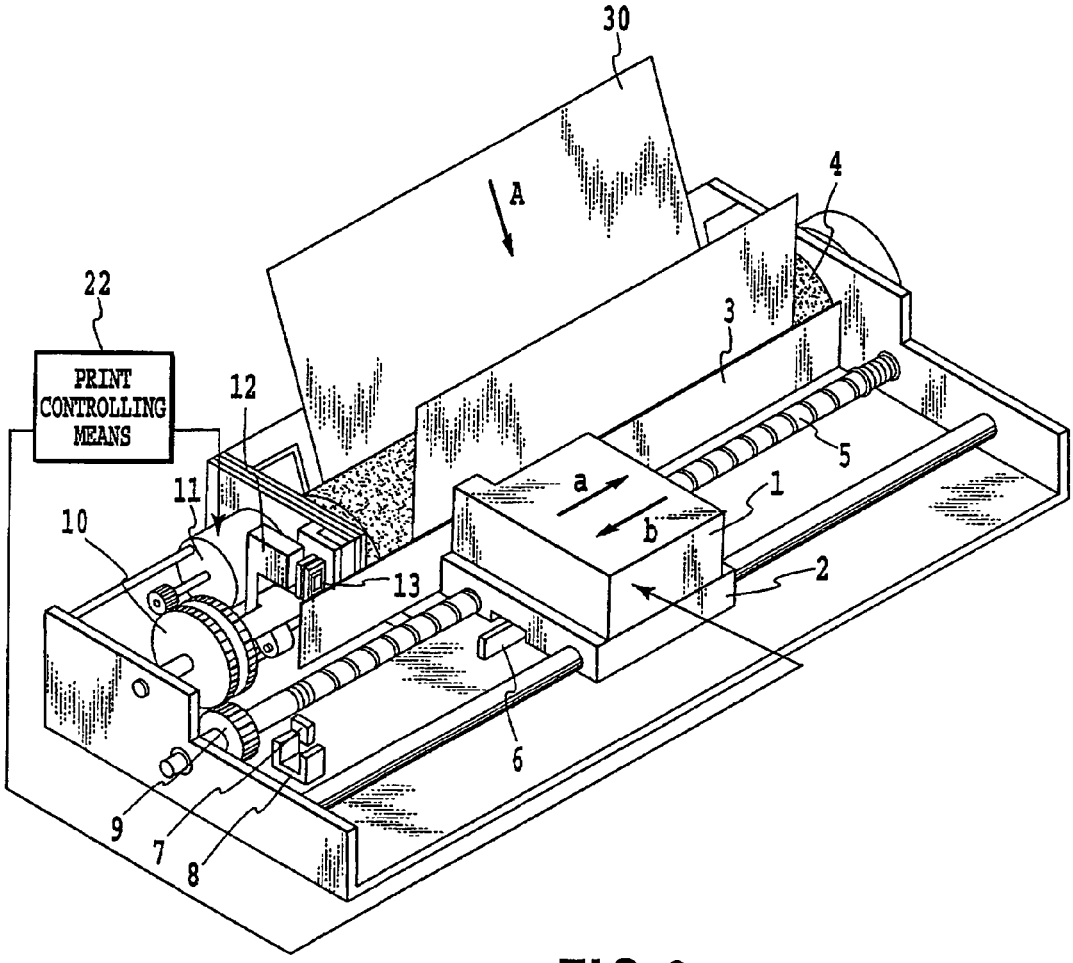
FIG. 2 is a perspective view showing an ink jet printer representing an embodiment of an ink jet printing apparatus according to the present invention.

FIG. 2 is a perspective view showing an ink jet printer representing an embodiment of an ink jet printing apparatus according to the present invention. In the drawing, a carriage 2 mounts an ink jet cartridge 1 which includes an ink tank (not shown) containing ink and a printing head (not shown) for ejecting the ink toward a printing medium 30 such as a printing sheet.

The printing sheet 30 is pressed onto a rotatable platen 4 by use of a sheet holder plate 3 disposed opposite to the ink jet cartridge 1. Then, the printing sheet 30 is retained at a given clearance from the ink jet cartridge 1 and is conveyed by the platen 4 in the direction indicated with an arrow A. The carriage 2 is reciprocated in the directions indicated with arrows a and b by rotation of a drive motor 11 transmitted to a lead screw 5 through drive force rotation gears 9 and 10. In this way, the printing head mounted on the carriage performs scanning on the bases of control from print controlling means 22.

A lever 6 is provided at one end of the traveling directions of the carriage 2, and two photocouplers 7 and 8 disposed inside the printing apparatus confirm the presence of the lever 6, and detect a home position for switching a rotation direction of the drive motor 11, and the like.

The carriage 2 stops at the home position, whenever necessary, at a start of printing or in the course of printing. A capping member 13 for capping a surface provided with an ejection port (an ejection port surface) of the ink jet printing head is disposed in this home position. A suction pump (not shown) configured to suction the ink forcibly from the ejection port and thereby to prevent the ejection port from clogging and the like is connected to this capping member 13. Meanwhile, a cleaning blade (not shown) wipes off stains and the like on a front surface of the printing head.

Figure 3:
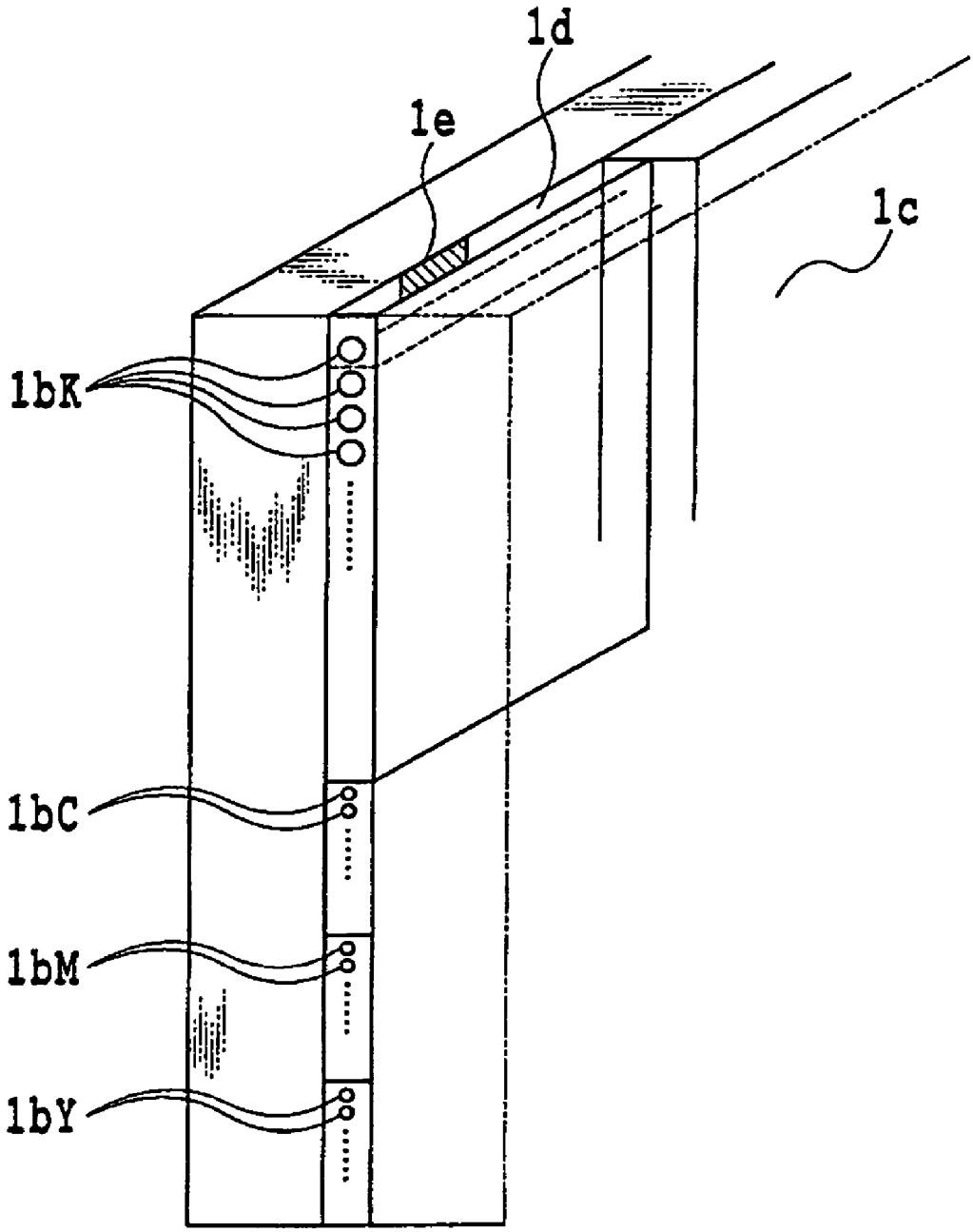
FIG. 3 is a perspective view of a printing head according to the embodiment of the present invention.

FIG. 3 is a partially abridged perspective view of the printing head mounted on the ink jet cartridge shown in FIG. 2. Multiple ejection ports 1*b*Y, 1*b*M, 1*b*C, and 1*b*K for ejecting ink in Y (yellow), M (magenta), C (cyan), and Bk (black), respectively, are arranged at a given pitch on a surface opposite to the printing medium 30. The printing head includes a common ink reservoir 1*c* provided for each of respective colors, the common ink reservoir being connected to each of respective ink tanks for each color. Ink paths 1*d* are provided correspondingly to the respective ejection ports in order to supply the ink from the common ink reservoir 1*c* to the respective ejection ports. Moreover, electrothermal converters 1*e* configured to generate energy for ejecting the ink are provided along wall surfaces of the respective ink paths 1*d*.

The ink which is supplied from the ink tank and temporarily stored in the common ink reservoir 1*c* enters the ink path 1*d* by a capillary action, and forms a meniscus at the ejection port 1*b* to maintain a state of filling the ink path 1*d* with the ink. At this time, when electricity is applied to the electrothermal converter 1*e* through electrodes (not shown) for causing heat generation, the ink at the ejection port 1*b* is abruptly heated and a bubble is generated inside the ink path 1*d*. The expanded bubble ejects the ink from the ejection port 1*b*.

FIG. 4 is a table showing results of sensory judgments for visibility of maintenance ejection of ink dots in various sizes onto the printing sheet. Here, the visibility is defined as inconspicuousness of an ink dot caused by maintenance ejection which is not intended for image formation, and represents a result of judgments by a panelist with 20/20 to 20/12.5 binocular vision in the state of being about 20 cm away from the printing sheet. A symbol "o" in the table indicates that the ink dot on the paper sheet is not recognizable. Meanwhile, a symbol "Δ" indicates that the ink dot is conspicuous on the paper sheet, and a symbol "x" indicates that the ink dot is more conspicuous on the paper sheet.

Plain paper that is frequently applied to high-speed printing is mainly used herein. Moreover, multiple types of plain paper considered in use worldwide such as ink jet plain paper subjected to light coating, high-quality paper mainly made of virgin pulp, recycled paper made of recycled pulp and bond paper containing cotton fibers are used herein.

At the same time, visibility is also confirmed for maintenance ejection onto heavy coating paper exclusively used for ink jet printing, which is required to achieve high color development and high definition. The maintenance ejection onto each of the paper sheets is investigated in light of comparison of visibility between the case of ejecting the ink onto a white portion of the paper sheet and the case of ejecting the ink onto a solid image printed in a different color from the ink used for the maintenance ejection. Yellow ink is used as a solid image printed in this investigation.

From these results, it is obvious that the visibility of the ink dot on the paper sheet is reduced (the ink dot becomes less conspicuous) as the ink dot size becomes smaller. In addition, even when the ink dot size is the same, it is apparent that the ink put on the solid image region has more visibility (the ink dot is more conspicuous) than the ink put on the white region.

The above-mentioned results of judgments represent the results of judgments on the case when a white background and a yellow background which is made by applying the yellow ink for the solid image are used. However, such results of judgments naturally vary depending on the color used for the solid image and also on environmental factors such as temperature and humidity at the time of printing. Therefore, the visibility may be different between the ink put on the white region and the ink put on the solid image region depending on the color used for the solid image and on the environmental factors even when using relatively large ink droplets that are approximately equal to 5 pl, for example.

Figure 5:
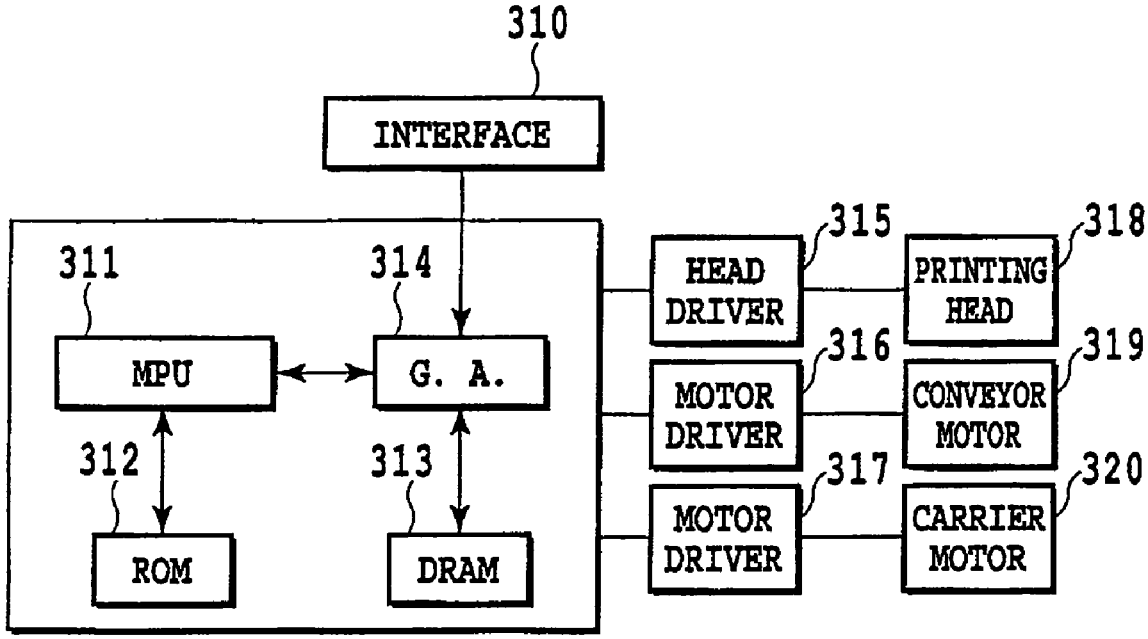
FIG. 5 is a block diagram showing a control configuration for performing image processing according to the embodiment of the present invention.

FIG. 5 is a block diagram showing a control configuration for performing image processing in this embodiment.

Reference numeral 310 denotes an interface for inputting an image signal, reference numeral 311 denotes a microprocessor unit (MPU), reference numeral 312 denotes a read-only memory (ROM) for storing a control program to be executed by the MPU 311, reference numeral 313 denotes a dynamic random access memory (DRAM), and reference numeral 314 denotes a gate array, respectively. RAM 313 is capable of saving various data such as printing signals and printing data to be supplied to a head, and of storing the number of printed dots and the number of replacement of the ink printing head as well. Reference numeral 315 denotes a head driver for driving a printing head 318, and reference numerals 316 and 317 denote motor drivers for driving a conveyor motor 319 and a carrier motor 320, respectively. The gate array 314 transfers data among the interface 310, the MPU 311, and the RAM 313, and supplies data used for image printing such as a scanning operation of the printing head and an ink ejecting operation by way of the respective drivers.

Figure 6:
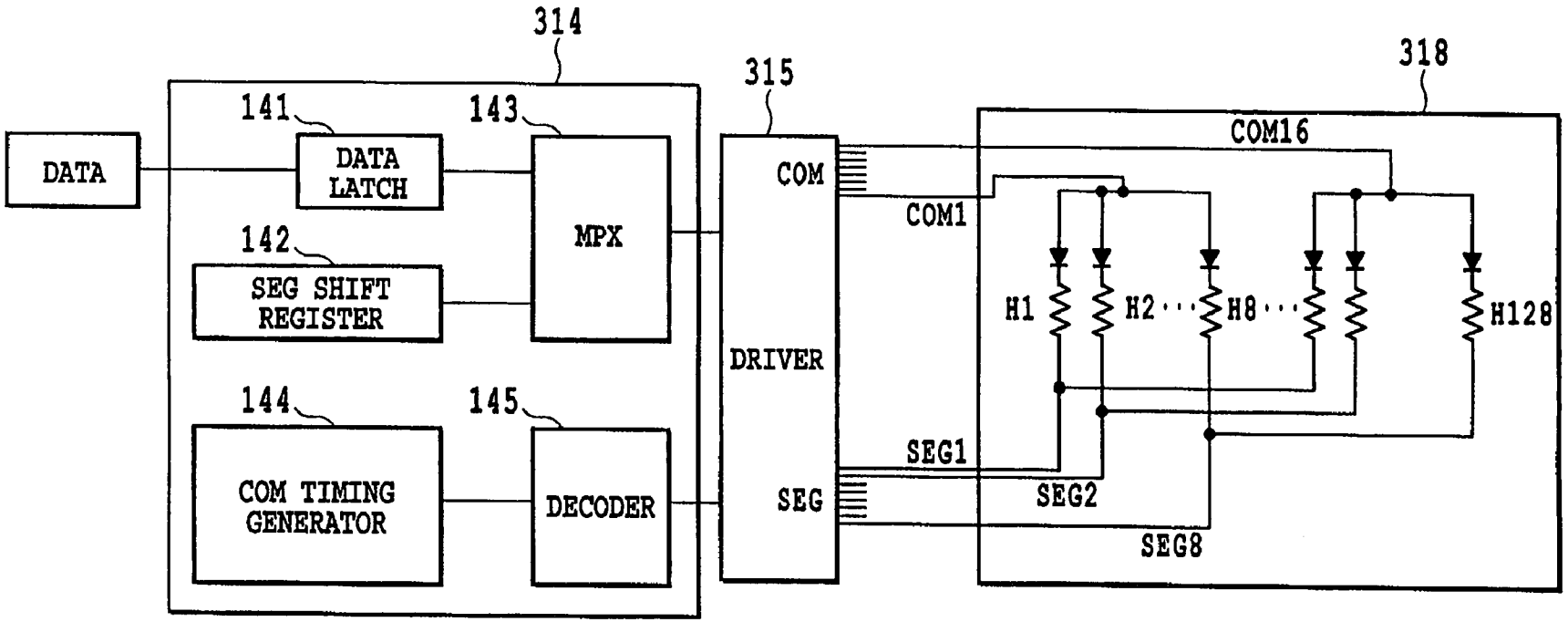
FIG. 6 is a circuit diagram showing a configuration of an apparatus for performing control related to the image processing according to the embodiment of the present invention.

FIG. 6 is a circuit diagram showing a configuration of a apparatus for performing control concerning image processing from the point of inputting an image signal to the gate array to the point of supplying image printing data to the printing head. The gate array 314 includes a data latch 141, a segment (SEG) shift register 142, a multiplexer (MPX) 143, a common (COM) timing generator circuit 144, and a decoder 145.

The decoder 145 decodes timing generated by the common timing generator 144 and selects one of common signals COM 1 to COM 8. The data latch 141 latches image data read out of the RAM 313 on a 8-bit basis. The multiplexer 143 outputs these printing data as segment signals SEG 1 to SEG 8 in accordance with the segment shift register 142. The outputs from the multiplexer 143 are variable depending on the contents of the shift register 142, such as a 1-bit basis, a 2-bit basis and all 8 bits.

When the image signals are inputted to the interface 310, the image signals are converted into the image data by and between the gate array 314 and the MPU 311, and ejection data for maintenance ejection for maintenance of the printing head is generated at the same time. Then, the ejection data are combined with the image data to generate the image printing data.

Printing is performed by driving the motor drivers 316 and 317 on the bases of the image printing data, and by driving the printing head in accordance with driving data transmitted to the head driver 315. The printing head 318 adopts a diode matrix configuration, in which drive current flows on any of ejection heaters (H1 to H128) where the common signal COM coincides with the segment signal SEG. In this way, the ink is heated and ejected.

Figure 7:
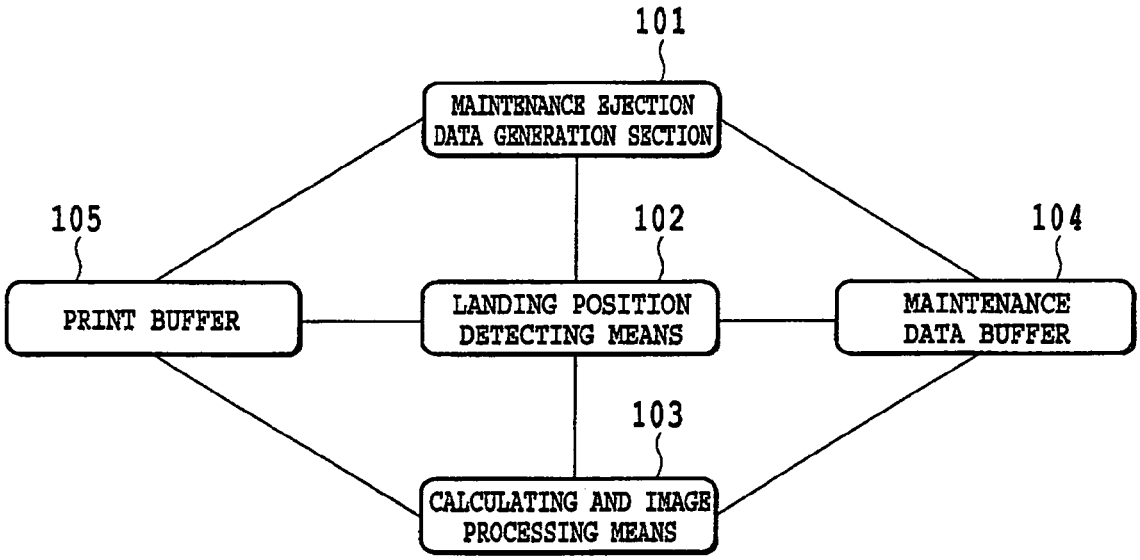
FIG. 7 is a block diagram showing a configuration for performing the control related to the image processing according to the embodiment of the present invention.

FIG. 7 is a block diagram showing a control configuration related to the image processing according to this embodiment. Reference numeral 101 denotes a maintenance ejection data generation section for generating a maintenance ejection data, reference numeral 102 denotes landing position detecting means for detecting whether the maintenance ejection data and the image data share a pixel at the same address, reference numeral 103 denotes image processing means for performing the image processing, reference numeral 104 denotes a maintenance data buffer for storing the maintenance ejection data, and reference numeral 105 denotes a print buffer for storing the image data, respectively. These constituents collectively perform the image processing described below.

Figure 8:
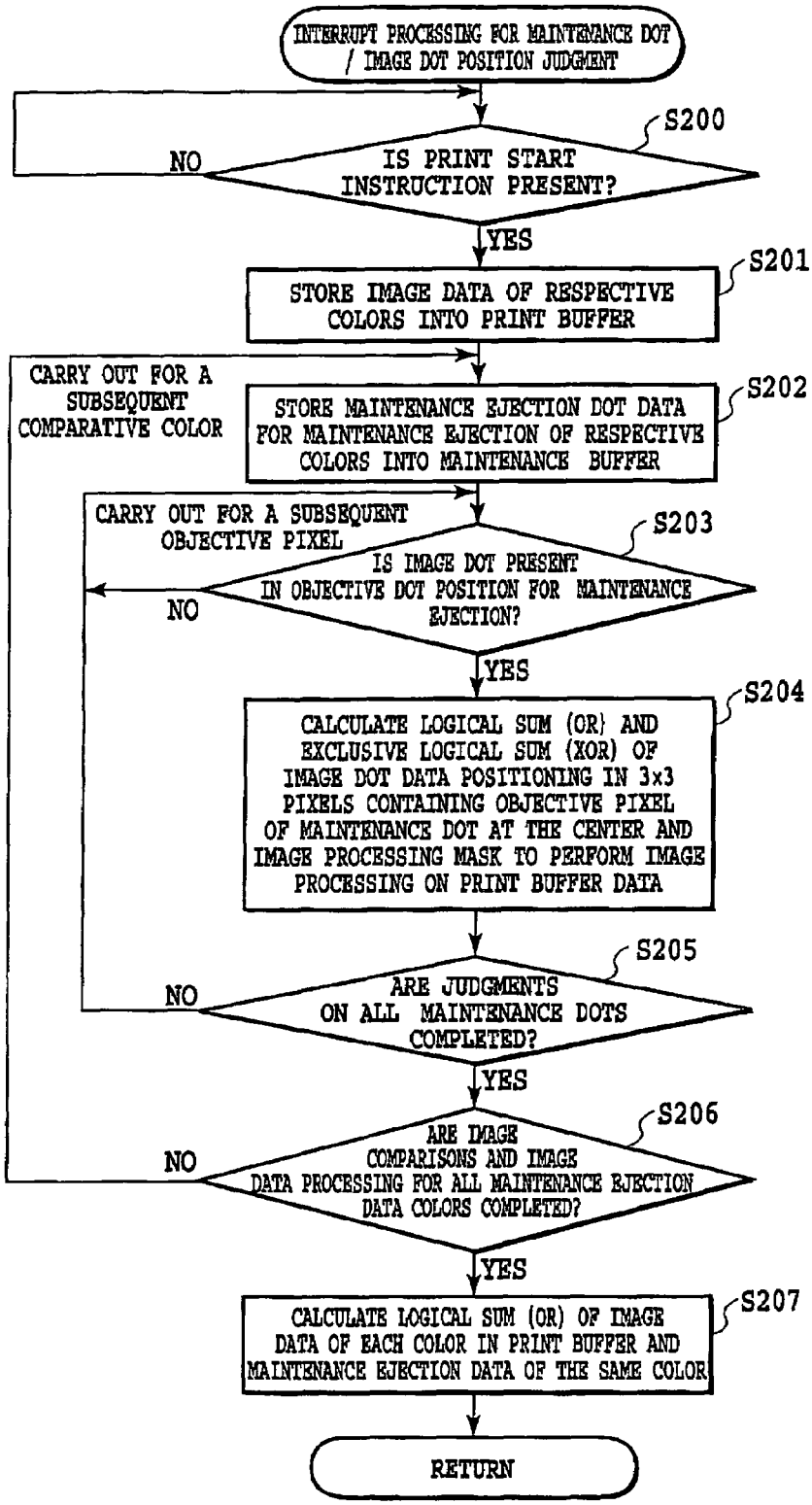
FIG. 8 is a flowchart showing image processing according to a first embodiment of the present invention.

FIG. 8 is a flowchart showing the image processing of this embodiment.

First, when a print start instruction is issued (S200), the image data on the respective colors is stored in the print buffer as bit drawing data consisting of 1 and 0 values (S201).

Next, the maintenance ejection data for the ink to be ejected onto the printing medium is generated as bit drawing data consisting of 1 and 0 values and is stored in the data buffer (S202). The ejection data for the maintenance ejection generated in this embodiment has a predetermined pattern formed by using the program stored in the ROM. The predetermined pattern may have a plurality of conditions by use of the control program. Specifically, the predetermined pattern may be changed depending on a moisture retention performance and the type (dye or pigment) of the ink used therein, and on an environmental temperature of a place where the printing apparatus is operated, which may constitute a viscosity increasing factor. A temperature sensor provided on the printing apparatus, for example, is used for detection of the environmental temperature.

In this embodiment, the predetermined pattern is used either directly or after being changed in accordance with the ink characteristics and the operating environment thereof. However, the pattern does not have to be predetermined. The pattern may also be generated for each image processing or for each data processing.

Moreover, in order to minimize visibility, on the printing medium, of the ink dots for the maintenance ejection not intended for image formation, the pattern is configured not to overlap ejecting positions of multiple types of ink to be ejected, and to avoid formation of continuous ink dots. It is more effective when a dot interval of the maintenance ejections is longer. In addition, it is desirable for the dot interval of the maintenance ejection to have low periodicity.

For example, as for the scanning direction of the printing head, it is desirable not to perform continuous ejection at a maximum frequency for driving the printing head. Ejection is performed at an interval from several millimeters to less than 20 mm in the scanning direction of the printing head, and is performed once for each nozzle without continuation in the direction of arrangement of nozzles. The number of ejection ranges approximately from 3 to 15 ejections within the width of movement of the printing head.

Memory positions where the maintenance ejection data of each color stored in the maintenance data buffer is present are sequentially detected from the head of memory. Then, a pixel at an address where the maintenance ejection data having value "1" is present, i.e. the pixel at the address having bit data 1, is defined as an objective pixel. Thereafter, among the image data stored in the print buffer, the data in the pixel position having the same address as the objective pixel is compared with the data in that objective pixel, thereby detecting whether or not image data having value "1" is present at the same address (S203). A logical product (AND) of bit data is used to compare the bit data of the objective pixel with the bit data at the same address as the pixel address. When a result shows that the AND is equal to 1, the image data having value "1" is present in the same position.

When a color of the ink for the maintenance ejection is the same as the color of the ink used in the image, there is no effect on the visibility of the ink dot of the maintenance ejection attributable to a bleed. Accordingly, it is only necessary to compare the image data in terms of different colors from the color of the ink used for the maintenance ejection. In the process of comparison operation of the maintenance ejection data of a color black, the maintenance ejection data is compared with the image data of colors of cyan, magenta, and yellow. Now, the process of comparison will be described below for the case where the maintenance ejection data is data of black while the image data is data of cyan as a first comparison color.

When a result of the comparison operation as to whether cyan image data having value "1" is present in the same pixel as the objective pixel shows that a cyan data having value "1" is not present in the same position, comparison operation is carried out for a subsequent objective pixel. On the other hand, if cyan image data having value "1" is present in the same position, a process using an image processing mask to be described below is performed on the image data in the print buffer (S204).

After completion of the operation of a first comparative color and the image processing, pixel position comparison and image processing are performed on second and third comparative colors. In this way, the image processing is performed on the maintenance ejection data and the image data of all colors.

To be more precise, when the black ink is an object for the maintenance ejection, the first comparative color is defined as cyan, the second comparative color is defined as magenta, and the third comparative color is defined as yellow, respectively. When the cyan ink is an object for the maintenance ejection, the first comparative color is defined as black, the second comparative color is defined as magenta, and the third comparative color is defined as yellow, respectively. When the magenta ink is an object for the maintenance ejection, the first comparative color is defined as black, the second comparative color is defined as cyan, and the third comparative color is defined as yellow, respectively. When the yellow ink is an object for the maintenance ejection, the first comparative color is defined as black, the second comparative color is defined as cyan, and the third comparative color is defined as magenta, respectively. Although the above-described comparison processes are conceivable, the order of maintenance ejection ink to be generated and the order of comparative colors do not have particular restrictions.

The above-described processing is carried out on all the objective pixels for the maintenance ejection (S205). Moreover, this processing is repeated until all the comparison operations between the maintenance ejection data and the image data, and the image processing are completed in terms of all colors (S206).

After generation of the maintenance ejection dots in all colors, the comparison operations of the pixel position, and the image processing are completed, the maintenance ejection data is incorporated into the image data. In order to incorporate the ejection data into the image data, a logical sum (OR) of the data in the maintenance data buffer for each color and the image data in the print buffer of the same color is calculated. Thus, the maintenance ejection data is combined with the image data in the print buffer, thereby generating the image printing data (S207).

After completing the combination, the process moves out of the processing routine of the present invention and returns to a printing sequence of the printing apparatus. The image printing data in the print buffer, which combines the maintenance ejection data, is transferred to the printing head. Accordingly, the maintenance ejection data not intended for the image formation is also transferred onto the printing sheet together with the original image data.

In the case of a serial printer (a line printer) represented by an ink jet printer, neither the print buffer nor the maintenance data buffer usually has the memory capacity which covers the entire region of a page (in an A4 size, for example) in light of the configuration of the printing apparatus. Concerning the print buffer and the maintenance data buffer in this embodiment, each session of the processing is carried out within the capacities of the buffers and the printing operation for the entire page will be completed by repeatedly updating the print buffer.

Figure 9:
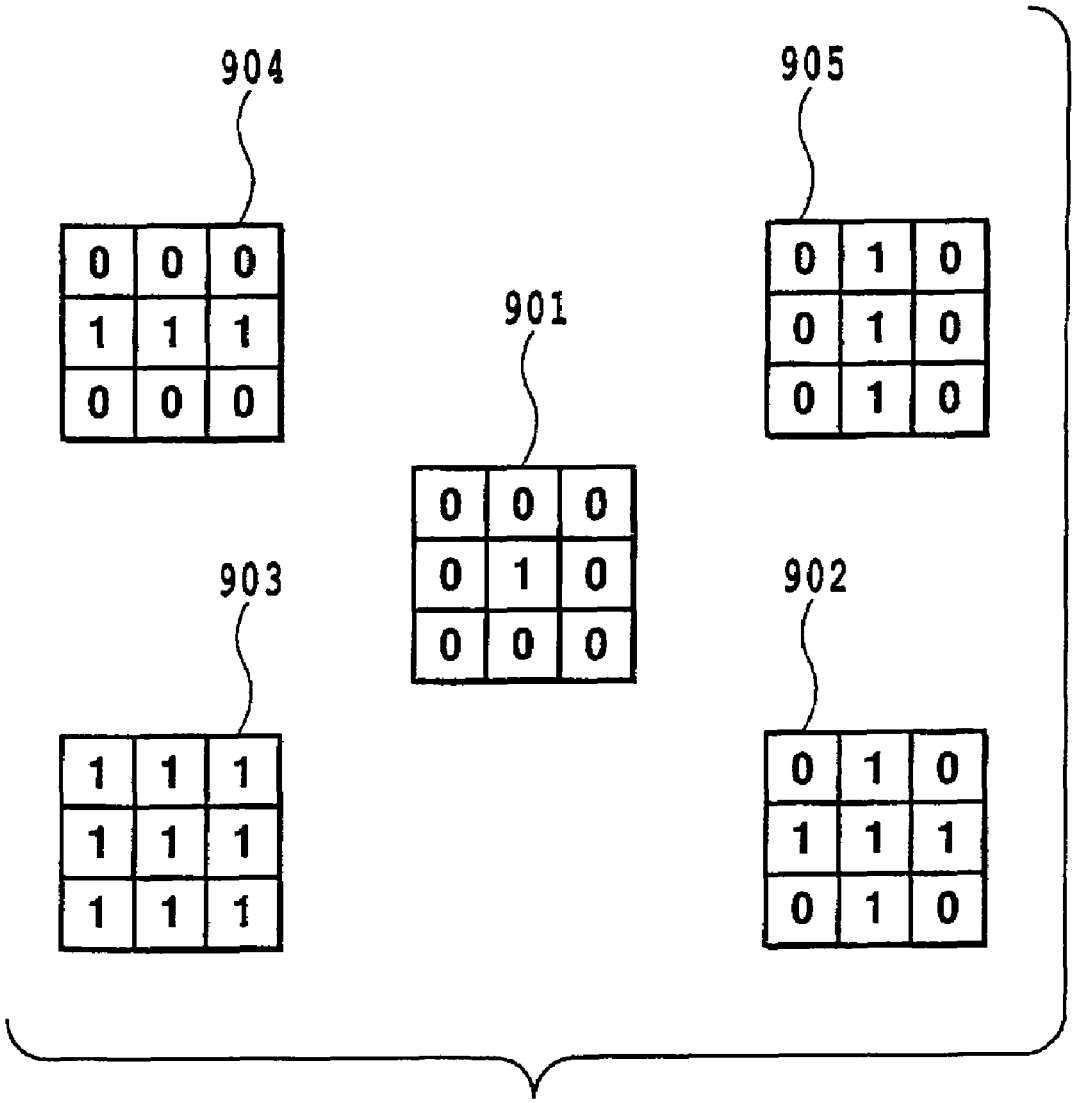
FIG. 9 is a view for explaining masks respectively aligned with resolution of a printed image according to the embodiment of the present invention.

FIG. 9 is a view showing examples of the image processing mask.

In FIG. 9, reference numeral 901 denotes a basic image processing mask for replacing a dot in the image data with the objective pixel in the maintenance ejection dot when there is a data having value "1" of an image color of which is different from the color of the maintenance ejection dot. The mask having dimensions of n×m (which is equivalent to a 3×3 configuration in this embodiment) of which the objective pixel of the maintenance ejection dot is positioned at the center is used as the mask herein.

A logical sum (OR) of this mask and the n×m dimensions of which the objective position of the image data in the print buffer is positioned at the center is calculated to combine the image data in the print buffer with the mask. Then, by calculating an exclusive logical sum (XOR) of the above combined image data in the print buffer and the mask, it is possible to carry out the image processing which thins out bit data portions representing 1 in the mask relative to the original image data in the print buffer. By this image processing, for the mask 901, an image dot equivalent to the objective pixel is thinned out.

The size of the image processing mask (a bit map size) is variable depending on the image processing performed on the image data. The number of dots in a region which is necessary for the image processing of the image dots (which is equivalent to the 3×3 dot size at the maximum covering adjacent pixels in this embodiment) does not have limitations. However, it is essential to consider avoiding a significant change in the printed image attributable to the image processing. The bit map size is adjustable in response to a degree of bleed of the ink used therein and to the area and a printing resolution pitch of printed dots on the sheet surface.

Image processing masks denoted by reference numerals 902 and 903 are effective when a bleed of the maintenance ejection dot is relatively large. As shown in the drawing denoted by reference numeral 902, the image processing mask is targeted for thinning out pixels having wide contact regions relative to the objective pixel because the maintenance ejection ink dot usually bleeds into solid image ink dots 220 in a different color and the shape of ink dot spreads irregularly. In particular, the image processing mask 903 is aimed at thinning out the objective pixel of the maintenance dot as well as the image data dots surrounding the objective pixel. This design is effective, for example, when the black maintenance ejection ink is used for the objective pixel in the case where a black ink dot diameter is larger than a diameter of the color ink dot due to a demand for high-speed and high-density printing of a monochrome image. Meanwhile, when the black ink is made of a pigment and the color ink is made of a dye, a bleed caused by the black ink and the color ink becomes larger due to a difference in the surface tension. Accordingly, this mask is effective when applied to the case of using the black ink as the objective pixel.

Reference numerals 904 and 905 denote masks aligned with the resolution of the printed image. For example, when the printing resolution has a configuration of 1200 dpi in the scanning direction and 600 dpi in the direction of arrangement of ink nozzles, an interval between the adjacent ink dots in the scanning direction is approximately equal to 21 μm while an interval between the adjacent ink dots in the direction of arrangement of the ink nozzles is approximately equal to 42 μm. In this case, the maintenance ejection dot and the image dot adjacent to each other in the scanning direction are apt to cause a bleed as compared to the adjacent dots in the direction of arrangement of the ink nozzles. Therefore, the mask 904 is configured to thin out only the peripheral pixels in the scanning direction.

Similarly, when the printing resolution has a configuration of 600 dpi in the scanning direction and 1200 dpi in the direction of arrangement of the ink nozzles, a similar effect is achieved by use of the mask 905 designed to thin out the peripheral pixels in the direction of arrangement of the ink nozzles.

Figure 10:
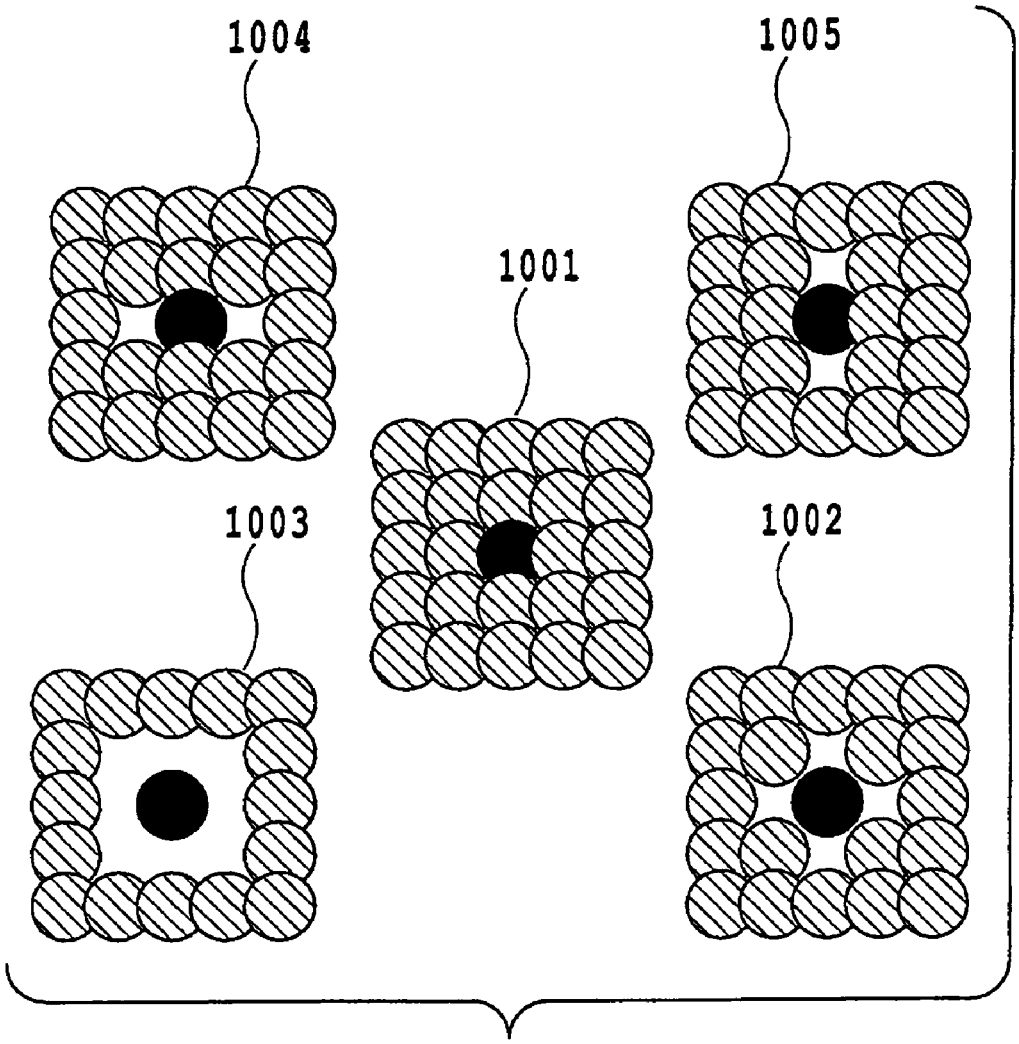
FIG. 10 is a schematic diagram showing printing results by use of the masks shown in FIG. 9.

FIG. 10 is a schematic diagram showing printing results by use of the above-described masks. Reference numeral 1001 denotes a printing result when using the mask 901. Similarly, reference numeral 1002 denotes a printing result when using the mask 902, reference numeral 1003 denotes a printing result when using the mask 903, reference numeral 1004 denotes a printing result when using the mask 904, and reference numeral 1005 denotes a printing result when using the mask 905. Note that the schematic diagram shown in FIG. 10 applies a 5×5 configuration so as to facilitate discrimination of thinning out results obtained by the image processing.

By performing the above-described processing, it is possible to reduce a bleed of the maintenance ejection dot on the sheet surface at the time of coincidence of the printed dots in the maintenance ejection data not intended for image formation and in the image data. In this way, the visibility of the maintenance ejection dot can be reduced.

Note that, while the method of generating the maintenance ejection dot is achieved by the control program executed by the MPU in this embodiment, it is also possible to apply hardware processing by use of the gate array. Meanwhile, the logical sum or the exclusive logical sum may be obtained by use of a function of the MPU or by use of a hardware login. Moreover, the processing may be carried out on a bit basis, a byte basis or a word basis. However, a large unit makes it possible to achieve high-speed processing.

In addition, generation of the maintenance ejection dots, and calculations of the logical sum and the exclusive logical sum in the course of the image processing may be executed simultaneously in the step of generating the image data in software processing of a host PC. In this case, a load on the host may be increased, but a load on the hardware in the printing apparatus is reduced.

Second Embodiment

In the image processing of the first embodiment, the image data for each color is stored in the print buffer as the bit picture data consisting of 1 and 0 values (S201). Then, the pixel position comparison between the objective pixel and the piece of data in the pixel position having the same address is performed to detect whether or not the image data is present at the same address (S203). Instead, the operation and the image processing may also be executed in terms of the image data for the ink in the same color as that of the maintenance ejection prior to carrying out the pixel position comparison.

Figure 11:
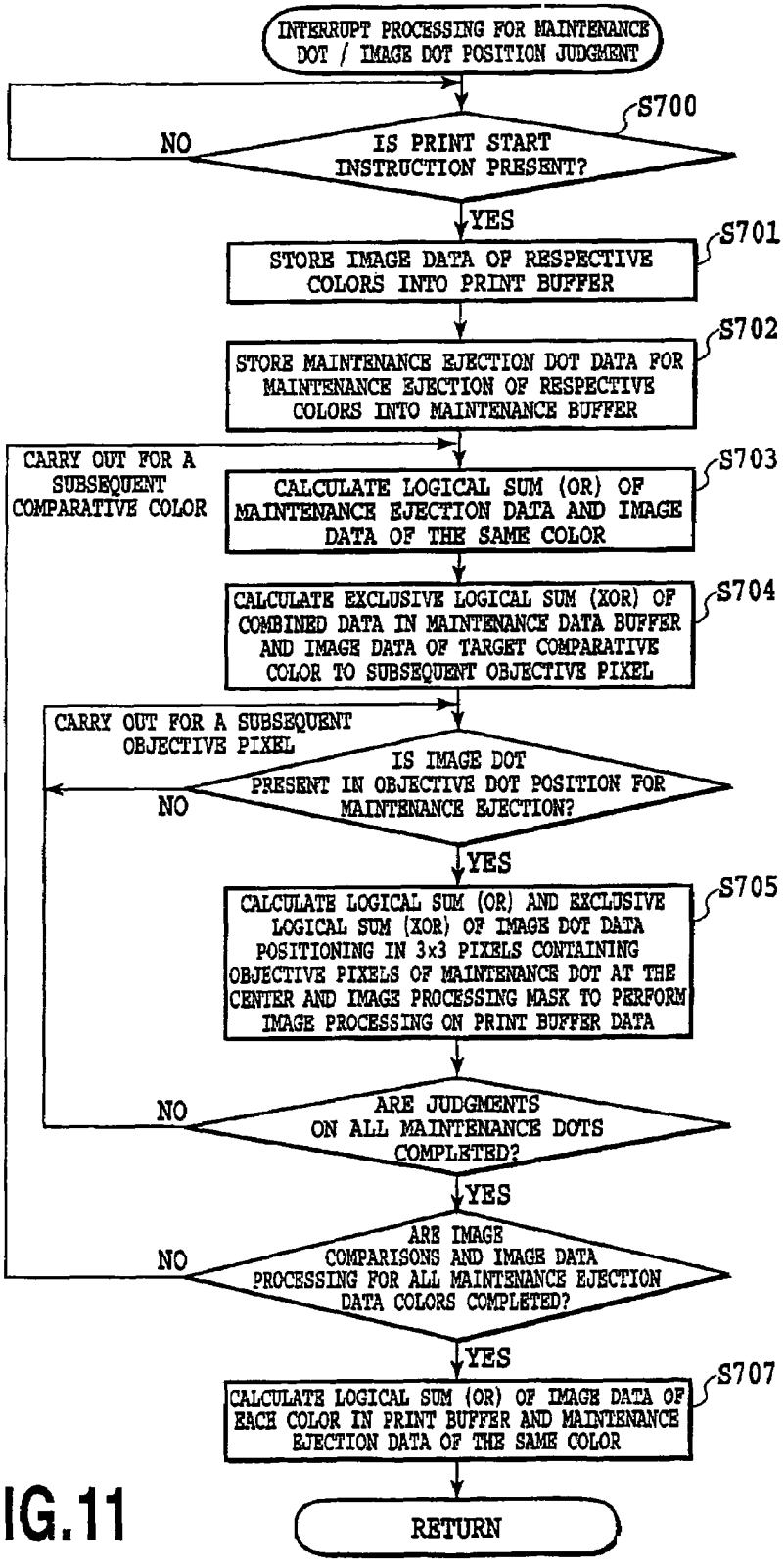
FIG. 11 is a flowchart showing image processing according to a second embodiment of the present invention.

FIG. 11 is a flowchart showing the image processing of the second embodiment.

First, in S702, the maintenance ejection data for each color is generated in the amount equivalent to the maintenance data buffer. Next, the logical sum (OR) of the image data of the same color and the maintenance ejection data in the maintenance data buffer is calculated and the combined data of the maintenance ejection data and the image data is generated in the maintenance data buffer (S703). Thereafter, the exclusive logical sum (XOR) of the combined data and the image data of the same color is calculated (S704). In this way, the maintenance ejection data from which the dots in the positions where the image data of the same color is present are deleted can be generated in the maintenance data buffer. From this point, in the same way as the case of the first embodiment, the pixel position comparison between the objective pixel of the maintenance ejection dot and the image data subject to the comparison operation is performed, and the necessary image processing is carried out (S705). After completion of the pixel position comparison, the logical sum (OR) of the maintenance data buffer and the image data of the same color is calculated to combine the maintenance ejection data required for the image data in the print buffer (S707).

As a result, the number of the objective pixels of the maintenance ejection dots subject to the pixel position comparison operation processing with the image data after the step S705 is reduced. Accordingly, excessive operation of the image processing may be prevented.

Third embodiment

While the embodiments 1 and 2 are configured to carry out the comparison and the operations in terms of all the cases where the image data is present in the objective pixels, when the image data applies the black ink, the image processing may be skipped. That is, when the image data applies the black ink, the ink dots generated by the maintenance ejection are concealed by the black ink and the visibility of the ink dots is therefore reduced.

Figure 12:
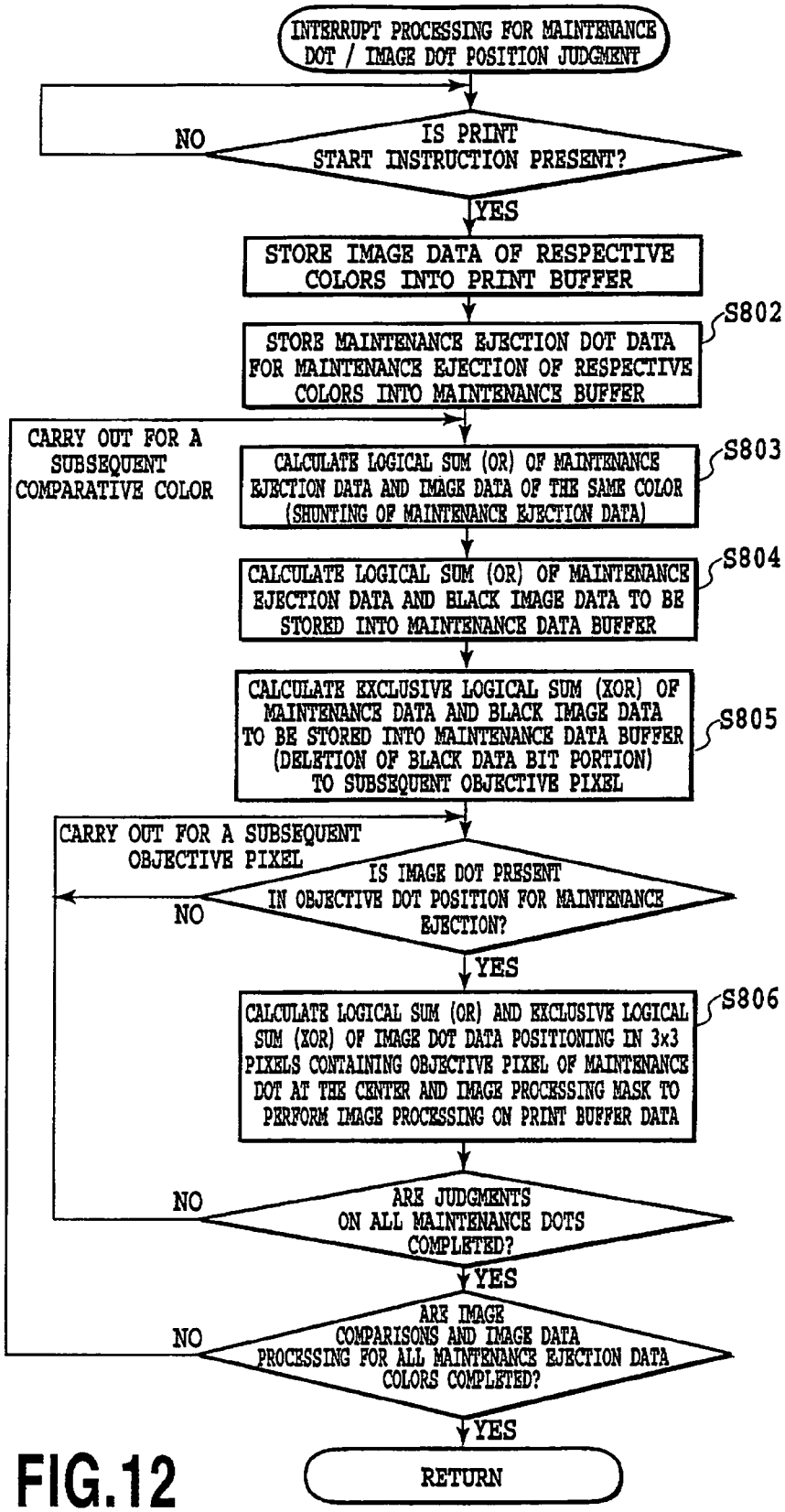
FIG. 12 is a flowchart showing image processing according to a third embodiment of the present invention.

FIG. 12 is a flowchart showing the image processing of the third embodiment.

In this embodiment, the logical sum (OR) of the maintenance ejection dot data and the image data of the same color is calculated in advance, and the maintenance ejection data is combined in the print buffer (S803). Accordingly, data corresponding to the bits where the black image data is present is deleted from the maintenance ejection data. Then, by calculating the logical sum (OR) of the maintenance data and the black image data, the maintenance data are combined with the black image data (S804). By calculating the exclusive logical sum (XOR) of the combined data of the maintenance data and the black image data, the dots in the positions where the black image data is present are deleted from the maintenance data (S805). Accordingly, the maintenance ejection data can be generated.

As a result, the image processing for the comparative colors is not carried out for the dot positions where the black image data is present. In this way, excessive operation of the image processing can be prevented.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2005-170014 filed Jun. 9, 2005, which is hereby incorporated by reference herein.

What is claimed is:

1. An image processing method of generating ejection data for an ink jet printing apparatus which includes a printing head for ejecting ink and ejects the ink from the printing head to form dots on a printing medium so as to perform printing, the method comprising the steps of:

generating maintenance ejection data for ejecting the ink from the printing head onto the printing medium for the purpose of maintaining the printing head;

performing a comparison operation between positions of maintenance ejection based on the maintenance ejection data and positions of dots to be printed; and generating the ejection data by thinning out the dots to be printed of a color different from a color of the ink used for the maintenance ejection, the thinned out dots to be printed on positions coinciding with the positions of maintenance ejection in the step of performing the comparison operation and by combining dot data which has been thinned out and the maintenance ejection data.

2. The image processing method according to claim 1, wherein the step of performing the comparison operation includes the step of calculating a logical product.

3. The image processing method according to claim 1, wherein the step of generating the ejection data includes the steps of:

calculating a logical sum of image data and a mask having an n×m configuration; and calculating an exclusive logical sum of the maintenance ejection data and a result of the logical sum.

4. The image processing method according to claim 1, wherein the step of generating the ejection data thins out the dots to be printed in a region defined as n×m, of which a position of the maintenance ejection is set at the center, where, n and m are equal to or greater than 1.

5. An ink jet printing apparatus which uses a printing head for ejecting ink and ejects the ink from the printing head to form dots on a printing medium so as to perform printing, the ink jet printing apparatus comprising:

means for generating maintenance ejection data for ejecting the ink from the printing head onto the printing medium for the purpose of maintaining the printing head;

means for performing a comparison operation between positions of maintenance ejection based on the maintenance ejection data and positions of dots to be printed; and means for generating the ejection data by thinning out the dots to be printed of a color different from a color of the ink used for the maintenance ejection, the thinned out dots to be printed on positions coinciding with the positions of maintenance ejection obtained by the means for performing the comparison operation and by combining the dot data which has been thinned out and the maintenance ejection data.

6. The ink jet printing apparatus according to claim 5, wherein the means for performing the comparison operation includes means for calculating a logical product.

7. The ink jet printing apparatus according to claim 5, wherein the means for generating the ejection data includes:

means for calculating a logical sum of image data and a mask having an n×m configuration; and means for calculating an exclusive logical sum of the maintenance ejection data and a result of the logical sum.

8. The ink jet printing apparatus according to claim 5, wherein the means for generating the ejection data thins out the dots to be printed in a region defined as n×m, of which a position of the maintenance ejection is set at the center, where n and m are equal to or greater than 1.

* * * * *